US005865326A

United States Patent [19]

Spamer et al.

[11] Patent Number: 5,865,326

[45] Date of Patent: Feb. 2, 1999

[54] WIRE RACK FOR FLANGED ARTICLES

[75] Inventors: William S. Spamer, Roswell; James D. Robertson, Atlanta, both of Ga.

[73] Assignee: The Mead Corporation, Dayton, Ohio

[21] Appl. No.: 104,086

[22] Filed: Jun. 24, 1998

Related U.S. Application Data

[63] Continuation of Ser. No. 781,088, Jan. 9, 1997.

[51] Int. Cl.[6] ..... A47F 5/14

[52] U.S. Cl. ..... 211/181.1; 211/59.2

[58] Field of Search ..... 211/59.2, 181.1, 211/106, 74; 248/312, 312.1, 220.22, 220.31

[56] References Cited

U.S. PATENT DOCUMENTS

| | | | |
|---|---|---|---|
| D. 198,421 | 6/1964 | Tome, III . | |
| 3,214,031 | 10/1965 | McCauley . | |
| 3,387,855 | 6/1968 | Oliver | 280/79.3 |
| 3,435,958 | 4/1969 | Chesley | 211/133 |
| 3,442,396 | 5/1969 | Cass | 248/220.21 |
| 3,977,529 | 8/1976 | Stroh | 211/187 |
| 4,072,246 | 2/1978 | Paulin . | |
| 4,318,485 | 3/1982 | Clement | 211/59.2 |
| 4,331,243 | 5/1982 | Doll | 211/59.2 |
| 4,344,540 | 8/1982 | Marschak | 248/220.31 |
| 4,367,818 | 1/1983 | Suttles | 211/59.2 |
| 4,401,221 | 8/1983 | Suttles | 211/59.2 |
| 4,415,091 | 11/1983 | Wolff | 211/50 |
| 4,416,380 | 11/1983 | Flum | 211/59.2 X |
| 4,467,926 | 8/1984 | Percival | 211/106 |
| 4,610,413 | 9/1986 | Pedersen | 248/220.31 |
| 4,694,966 | 9/1987 | Sorenson et al. | 211/181.1 |
| 4,863,131 | 9/1989 | Kinseley | 211/59.2 |
| 4,936,565 | 6/1990 | Fredrickson | 211/59.1 |
| 5,394,997 | 3/1995 | Gollob . | |

FOREIGN PATENT DOCUMENTS

WO 94/10885 5/1994 WIPO .

*Primary Examiner*—Peter M. Cuomo
*Assistant Examiner*—Anthony D. Barfield
*Attorney, Agent, or Firm*—Tsugihiko Suzuki

[57] ABSTRACT

A rack for flanged articles comprises a pair of front and rear opposed parallel transverse support members, and a pair of longitudinal members extending between the front and rear support members. Each of longitudinal member is formed of a wire strip and comprises a straight portion and an upturned forward end portion. The straight portions of the longitudinal members extend forward from the rear support member to positions below the front support member. The straight portions are disposed to form a pair of spaced parallel rails for receiving therebetween a row of articles such that the articles are slidably engaged at the undersides of their flanges with the rails, and thereby the articles are suspended by their flanges for movement along the rails. The upturned forward end portions of the longitudinal members extend upward to the front support member and secured to the same to form a brace for interconnecting the rails and the front support member. The upturned forward end portions are divergent toward the front support member so that an exit for the articles is defined between the upturned forward end portions.

14 Claims, 7 Drawing Sheets

WIRE RACK FOR FLANGED ARTICLES

This is a continuation of application Ser No. 08/781,088, filed Jan. 9, 1997, which is hereby incorporated by reference.

BACKGROUND OF THE INVENTION

The present invention relates generally to racks for flanged articles such as stemware and flanged bottles, and, more particularly, to a suspension-type display rack having an elongate track for slidably supporting flanged articles in pendant position.

Suspension-type display racks have been used in the merchandising of soft drink bottles such as PET bottles having outwardly projecting annular neck flanges. These racks have article-supporting tracks arranged side by side in a parallel relationship. Each track has a pair of spaced parallel rails extending along that track. The necks of flanged bottles are received between the rails of each track so that the bottles are engaged at their neck flanges with the rails and thus suspended from the respective track. The bottles received in each track are automatically arranged in a tidy row along that track and presented for removal by customers through the front end of the track.

Typically, each track is manufactured separately as a part or parts of a rack, and several separate tracks are assembled together into a shelf-like unit. Then, one or more of such units are mounted on suitable vertical support means such as a four-post framework to complete a rack. Examples of these conventional bottle racks are disclosed in U.S. Pat. Nos. 4,318,485; 4,367,818; and 4,401,221 which are owned by the assignee of the present invention. These bottle racks, on one hand, have certain adjustability in size and number of tracks. On the other hand, however, their manufacturing cost is high and their assembly is time-consuming.

Suspension-type wire racks are well known in the field of storage of stemware such as wine glasses, goblets or the like. Stemware glasses are engaged at their foot flanges with the track rails and thus suspended upside-down from the tracks. An example of conventional wire racks for stemware is disclosed in U.S. Pat. No. 3,214,031. Wire racks are inexpensive and easy to manufacture as compared to those bottle racks formed of sheet metal or plastic. Specifically, they do not require much assembly at the points of installation. However, when applying known wire arrangement to bottle racks, it is essential to take account of structural strength or rigidity of such bottle racks because of the significant difference in weight between empty stemware and filled bottles.

What is needed, therefore, is a suspension-type rack for flanged articles which is inexpensive, easy to manufacture and ready to use without substantial assembly. Such racks should have simple and sturdy arrangement for supporting the front ends of the tracks.

SUMMARY OF THE INVENTION

According to the invention in one form, a suspension-type rack is provided with a special arrangement for suspending the front end of a two-rail track without blocking the exit from the track. The rack comprises a transverse support member disposed transversely of the track and located at the position above the front end of the track, and a pair of brace elements disposed at the front end of the track. The brace elements extend upwardly from the rails to the transverse support member to interconnect the rails with the transverse support member. The brace elements diverge from each other as extending toward the transverse support member so that the exit is defined between the brace elements.

In a preferred embodiment, the brace elements extend upwardly from the rails in a parallel relationship to better function as a stopper and are turned away from each other to be divergent toward the transverse support member and to thereby provide the exit.

In another preferred embodiment, each brace element is formed from a length of the associated rail upturned relative to the immediately preceding length of the associated rail. The angle defined between the upturned length and the preceding length is no more than 90 degrees, and preferably between 75 to 90 degrees.

In a further preferred embodiment, the rack comprises vertical support means for supporting the track in an elevated position. The vertical support means may be the one for converting the rack into a gravity-feed article dispensing device wherein the track is inclined downwardly toward the front end. Alternatively, the vertical support means may support the track in a horizontal position.

According to the invention in another form, a rack comprises a pair of front and rear opposed parallel transverse support members, a track extending from the rear support member to a front end below the front support member, and a stopper for engagement with the leading article on the track to prevent it from exiting the front end of the track till its removal is desired. The stopper is provided at the front end of the track and comprises a pair of brace elements extending upwardly from the respective rails to the front support member. The brace elements diverge from each other as extending toward the front support member to define an exit of the articles.

In a preferred embodiment, the front and rear support members are interconnected by a pair of opposed side members to form a rectangular frame.

According to the invention in a further form, a wire rack is provided. Such wire rack comprises a pair of front and rear opposed parallel transverse support members, and a pair of longitudinal members each comprising first and second continuous lengths. The first lengths of the longitudinal members extend forward from the rear support member to the positions below the front support member and form a pair of spaced parallel rails for slidably receiving a row of articles between them. The second lengths of the longitudinal members are upturned relative to the respective first lengths and extend from the aforesaid positions to the front support member to form a brace structure for interconnecting the rails with the front support member. The second lengths diverge from each other as extending toward the front support member so that an exit of the articles is defined between the second lengths.

The objects and advantages of the present invention will be apparent from the following description, the accompanying drawings and the appended claims.

DETAILED DESCRIPTION OF THE PREFERRED EMBODIMENTS

Figure 1:
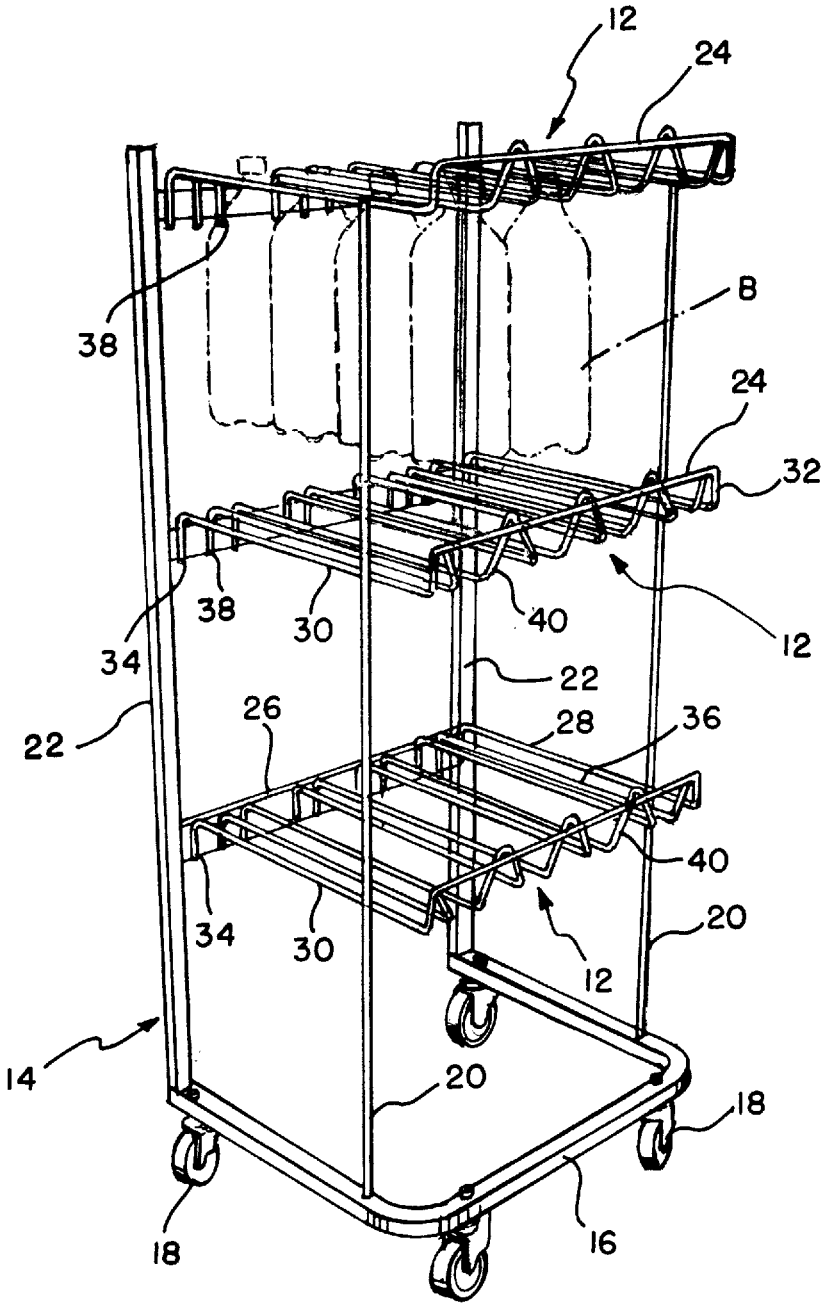
FIG. 1 is a perspective view of a rack according to the present invention.

FIG. 1 illustrates a display rack according to the invention. The illustrated rack is designed for dispensing bottles. The rack includes a plurality of shelf units 12 and a framework 14 supporting the shelf units 12 in a tiered relationship. The framework 14 includes a U-shaped base 16 with casters 18, and front and rear posts 20 and 22 upstanding from the base 16 to form a conventional four-post structure. The rack may have only one shelf unit 12. However, it will in general have two or more shelf units 12 as shown in FIG. 1.

The front and rear posts 20 and 22 are interconnected by the shelf units 12 to form a rigid construction. Each front post 20 is formed from a solid metal rod or heavy-duty wire while each rear post 22 is formed from a metal tube or folded sheet metal. As formed of metal, the shelf units 12 are welded to the front and rear posts 20 and 22 at desired elevations. Alternatively, the shelf units 12 are connected to the framework 14 by any suitable mechanical fasteners such as hook-and-slot joints, bolts and nuts, rivets or the like.

Figure 2:
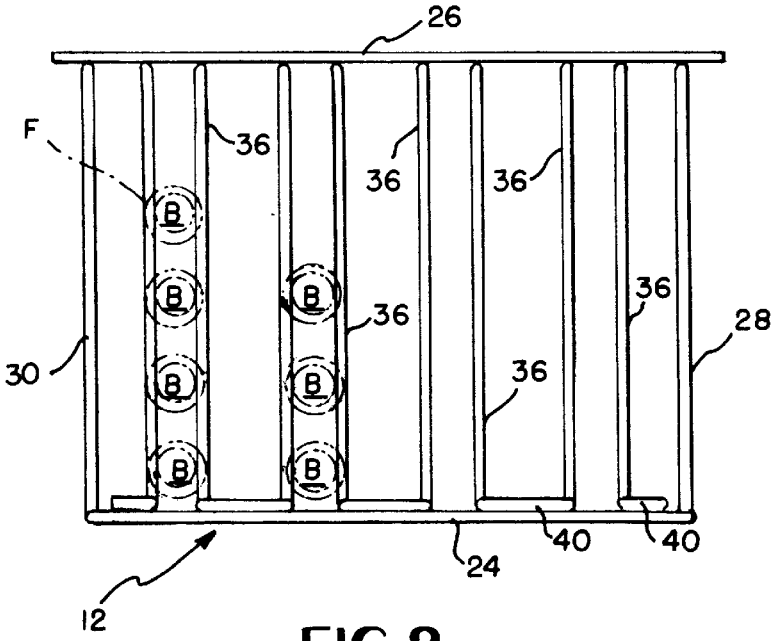
FIG. 2 is a plan view of one of the shelf units in FIG. 1.
Figure 3:
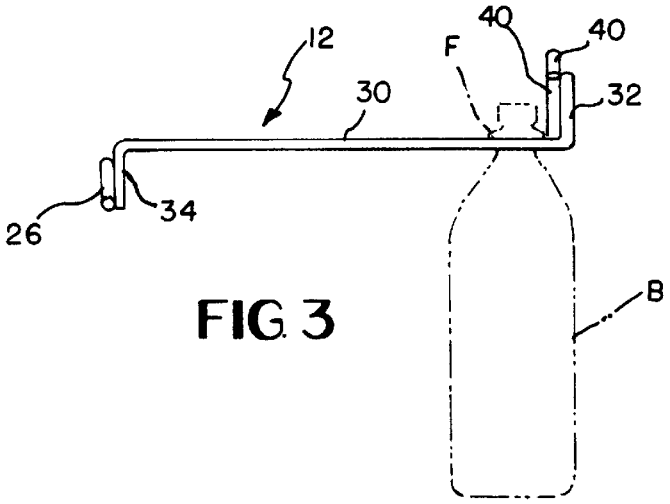
FIG. 3 is a side elevation of the shelf unit in FIG. 2.
Figure 4:
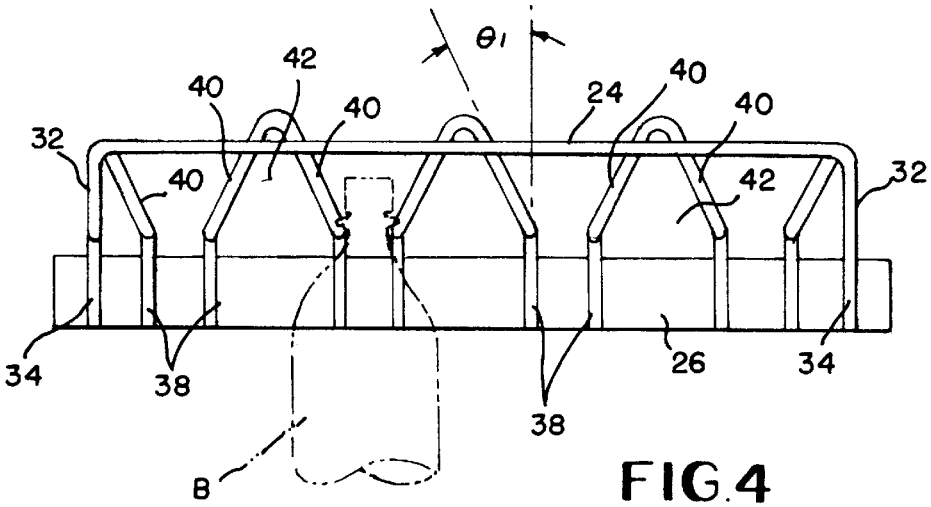
FIG. 4 is an enlarged front view of the shelf unit in FIG. 2.

One of the shelf units 12 in FIG. 1 is illustrated in detail in FIGS. 2–4. Since all the shelf units 12 are virtually identical, only the one shelf unit 12 is described hereinafter. The shelf unit 12 includes a pair of front and rear opposed transverse support members 24 and 26 interconnected by a pair of opposed side members 28 and 30. These members 24, 26, 28 and 30 form an essentially rectangular frame as viewed in FIG. 2. The rear support member 26 is a slat formed of a folded sheet metal and is extended between the rear posts 22. The opposite ends of the rear support member 26 are connected or jointed to the rear posts 22 by suitable means as mentioned earlier. The side members 28 and 30 are welded at their respective downturned rear end portions 34 (shown in FIGS. 3 and 4) to the front surface of the rear support member 26 and extended forward generally horizontally. The side members 28 and 30 are welded at their horizontally extending portions to the front posts 20 respectively, and are bent about 90 degrees upward at the positions below the front support member 24. As best shown in FIG. 4, the upturned forward end portions 32 of the side members 28 and 30 are joined at their upper ends to the opposite ends of the front support member 24. The front support member 24 and the side members 28 and 30 are preferably bent from a single continuous strip of wire.

As shown in FIG. 2, the shelf unit also includes a plurality of longitudinal members 36 extending between the front and rear support members 24 and 26. These longitudinal members 36 are welded at their downturned rear end portions 38 (shown in FIGS. 1 and 4) to the rear support member 26 and extended forward in a spaced parallel relationship. Adjacent ones of the longitudinal members 36 are spaced alternately relatively closely together and relatively widely apart. The longitudinal members 36 of each more closely spaced pair serve as rails for receiving therebetween the necks of flanged bottles "B". The distance between the members 36 of each closely spaced pair is equal to or slightly greater than the diameter of each bottle neck. Bottles "B", when received between the pair of rails, are slidably engaged at the undersides of their neck flanges "F" with the rails and thereby are suspended from the shelf unit 12 for sliding movement along the rails. Stated differently, each more closely spaced pair of longitudinal members 36 provide a bottle-supporting track extending from the rear support member 26 to the location below the front support member 24. The longitudinal members 36 are turned or bent upward at the location below the front support member 24 and are then welded at the upturned portions 40 to the front support member 24. The angle of the upturned portions 40 with respect to the rails may be about 75 to 90 degrees and preferably about 85 to 90 degrees. These upturned portions 40 serve not only as braces for connecting the front ends of the tracks to the front support member 24 but also as stoppers for preventing the supported bottles from exiting the front ends of the tracks until their removal is desired.

As illustrated in FIG. 4, the upturned portions 40 of the longitudinal members 36 of each track-forming pair diverge from each other toward the front support member 24. The angle "θ1" of the upturned portions 40 with respect to the vertical may be about 20 to 40 degrees and preferably about 30 degrees. These upturned portions 40 in the divergent positions define therebetween an exit of bottles "B", i.e., an opening 42 of the size larger than the diameter of the bottle flanges. More specifically, the upturned portions 40, i.e., the stopper, does not permanently block the front end of the respective track but permit removal of the suspended bottles when it is desired. Furthermore, the divergent upturned portions 40 provide rigid and reliable structural support for preventing horizontal displacement of the rails because they are subject to less moment about the welding point on the front support member than those conventional vertical braces.

The longitudinal members 36 of each more widely spaced pair are joined together at their upturned portions 40 and form a peaked loop as best shown in FIG. 4. In other words, adjacent longitudinal members 36 of neighboring tracks are formed from a single continuous strip of wire. However, the longitudinal members 36 located next to the side members 28 and 30 are disposed alone as they have no neighboring track.

The bottles suspended from the above described rack can be removed or dispensed one by one from the front end of each track while the bottles are prevented from accidentally exiting the tracks. More specifically, when at the front end of each track, a bottle abuts at its flange "F" on the bottoms of the associated upturned portions 40 and is thereby prevented from exiting the front end. However, when such a bottle is slightly lifted as it is pulled forward, the flange "F" of the bottle clears the upturned portions 40 and exit through the opening 42 between the upturned portions 40. To replenish the rack, bottles can be loaded into the tracks through the openings 42 by reversing the sequence of the bottle-removing steps.

Figure 5:
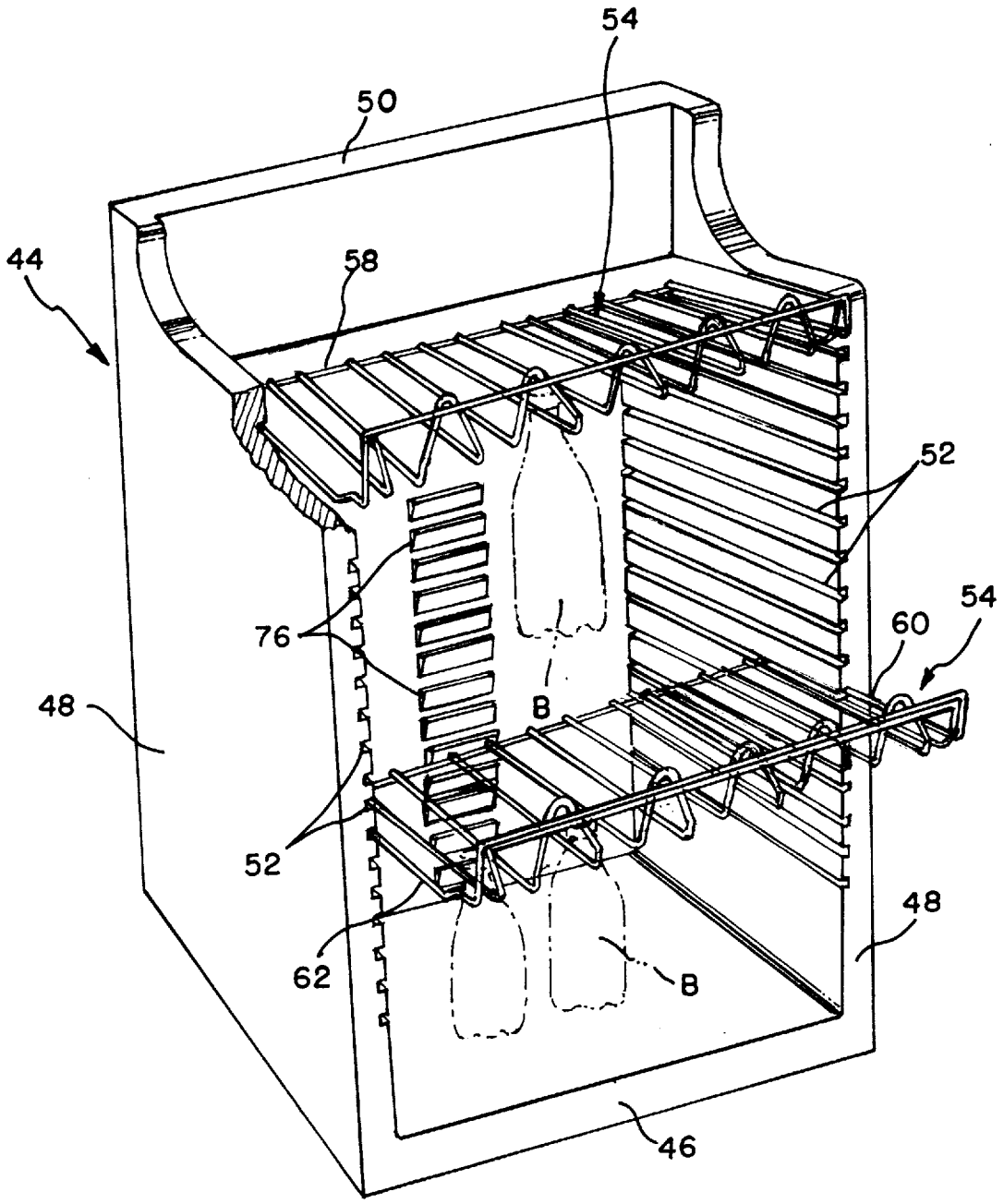
FIG. 5 is a perspective view of a rack of the second embodiment according to the present invention.

FIG. 5 illustrates a second embodiment of the rack according to the invention. The rack of this embodiment employs a different support structure 44 in place of the framework 14 in the first embodiments. The support structure 44 is a unitary plastic body of a rotation- or blowmolded construction which comprises a base 46, a pair of side walls 48 and a back 50. The inside surfaces of the side walls 48 are formed with channel-shaped horizontal grooves 52. The grooves 52 in each side wall 48 are vertically arranged at equal spacings. The details of the molded structure 44 is described in U.S. Pat. No. 5,394,997 which is hereby incorporated by reference.

Figure 6:
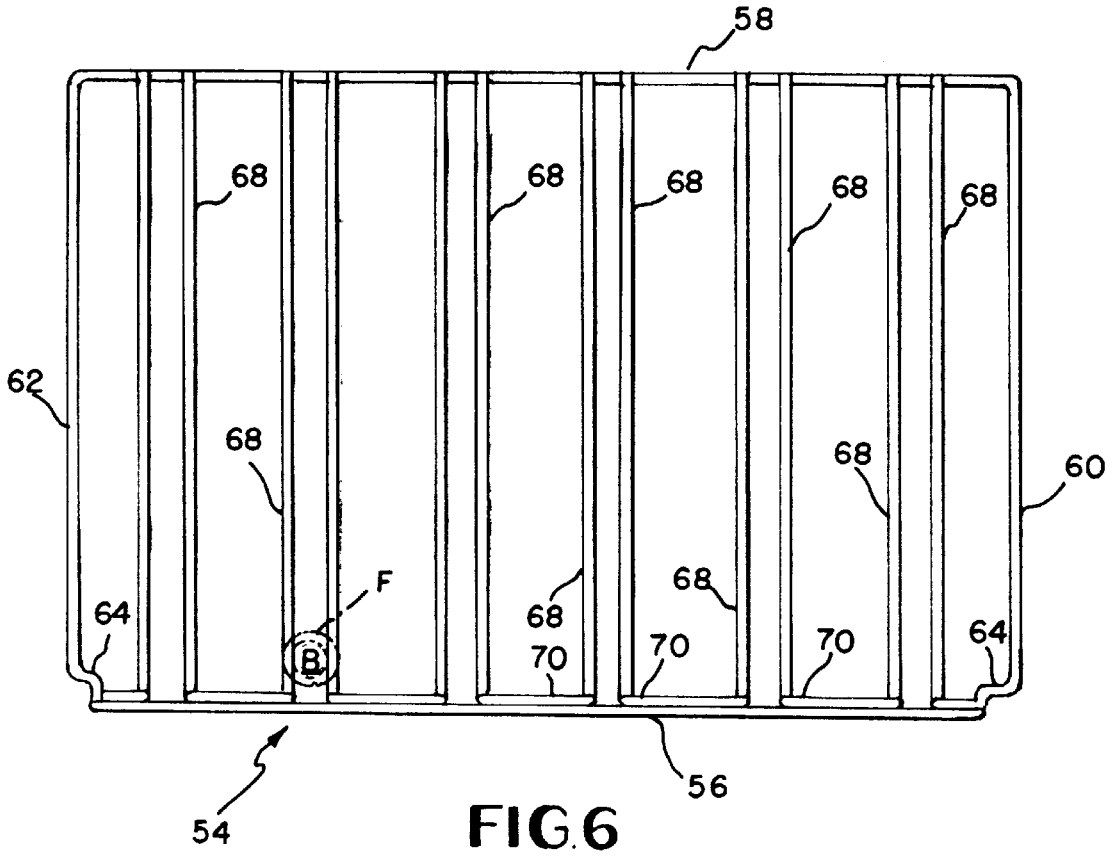
FIG. 6 is a plan view of one of the shelf units in FIG. 5.

Shelf units 54 in this embodiment are wirework formed of wire alone. As shown in FIG. 6, each unit 54 comprises a pair of front and rear support members 56 and 58 interconnected by the side members 60 and 62. These members 56, 58, 60 and 62 are preferably formed from a single continuous strip of wire. Each side member is cranked at the portion 64 to locate the majority of its horizontal length at the position outwardly offset from the respective upturned portion 66 (shown in FIG. 7). The offset lengths of the side members 60 and 62 provide engaging means to be received in the grooves 52 of the support structure 44 so that the respective shelf unit 54 is supported at a desired elevation.

Figure 7:
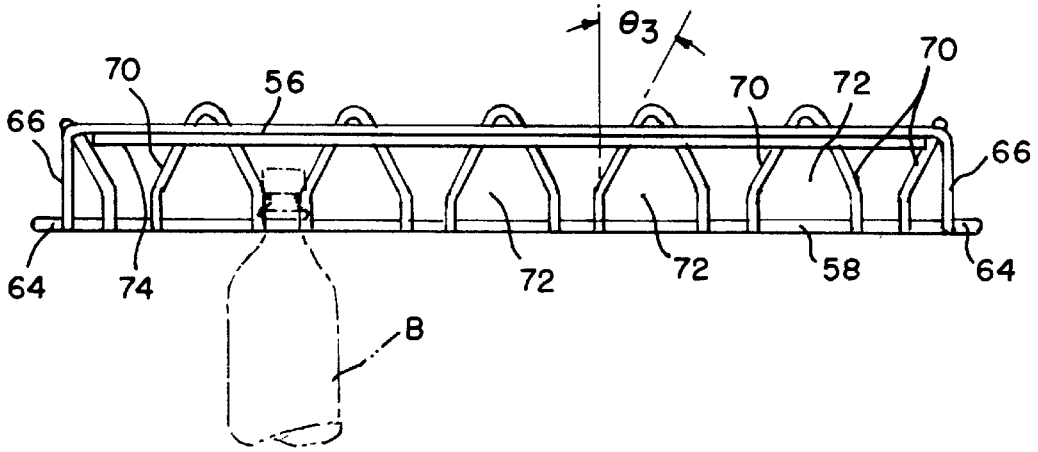
FIG. 7 is a front view of the shelf unit in FIG. 6.
Figure 8:
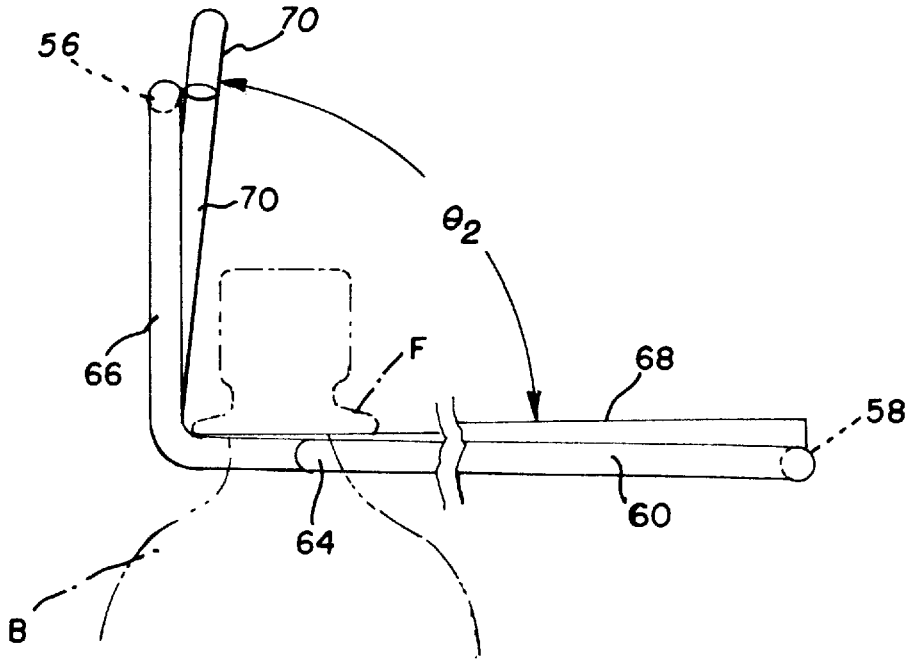
FIG. 8 is a fragmentary side elevation of the shelf unit in FIG. 6.

Spaced parallel longitudinal members 68 are extended between the front and rear support members 56 and 58. The rear ends of the longitudinal members 68 are welded to the rear support member 58 while the forward end portions 70 of the members 68 are bent upward at angle "θ2" (shown in FIG. 8) and welded to the front member 56. Angle "θ2" may be about 75 to 90 degrees and preferably about 85 to 90 degrees. The more closely spaced pairs of longitudinal members 68 serve as track rails in the same manner as the longitudinal members 36 in the first embodiment whereas the more widely spaced pairs are joined together at their respective upturned portions 70 and form peaked loops as best shown in FIG. 7. The upturned portions 70 differ from those in the first embodiment in that the portions 70 of the longitudinal members 68 of each track-forming pair extend upwardly from the respective track rails in a parallel relationship for a short distance and then are turned away from each other to be divergent toward the front support member 56. The divergent lengths of the upturned portions 70 define therebetween an exit 72 of bottles "B" in the same manner as the portions 40 in the first embodiment while the parallel lengths of the upturned portions 70 provide a stopper which better functions to prevent the bottles from accidentally exiting the respective track. The angle "θ3" of the divergent length with respect to the parallel length may be about 20 to 40 degrees and preferably about 30 degrees. The reference numeral 74 in FIG. 7 designates a transverse member welded to the front support member 56 to reinforce the structural rigidity of the shelf unit 54.

Returning to FIG. 5, each shelf unit 54 is inserted between the side walls 48 of the support structure 44 such that the opposite side members 60 and 62 of each unit 54 are slidably received in a pair of opposed grooves 52 at the same elevation. The lower shelf unit 54 in FIG. 5 is shown in the condition where it is in the process of insertion. The shelf unit 54 is inserted or slid in until its rear support member 58 reaches the back 50. When fully inserted, the rear support member 58 rest on one of the protrusions 76 on the back 50. The upper shelf unit 54 in FIG. 5 is shown in the condition where it is fully inserted.

Figure 11:
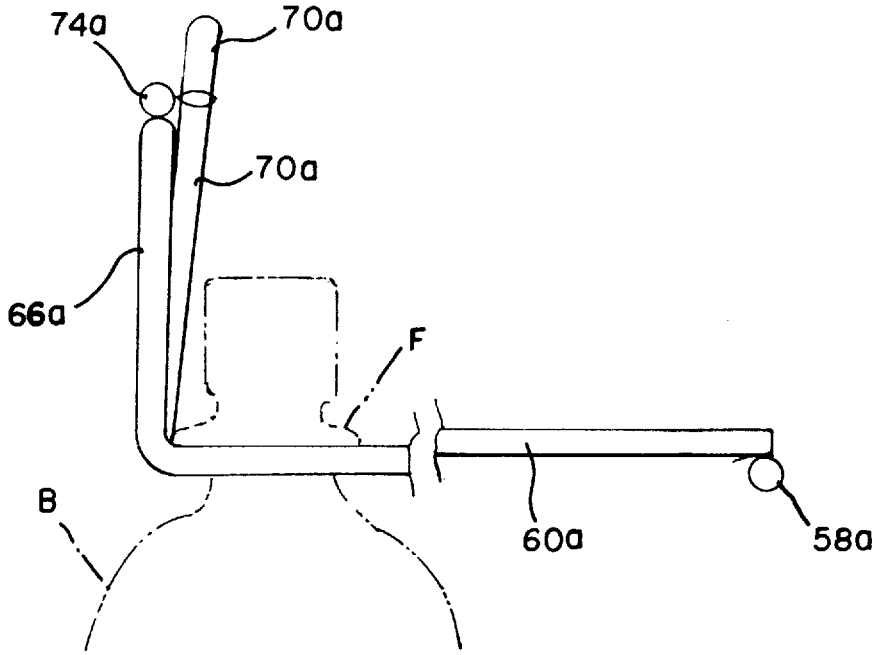
FIG. 11 is a fragmentary side elevation of the shelf unit in FIG. 9.
Figure 9:
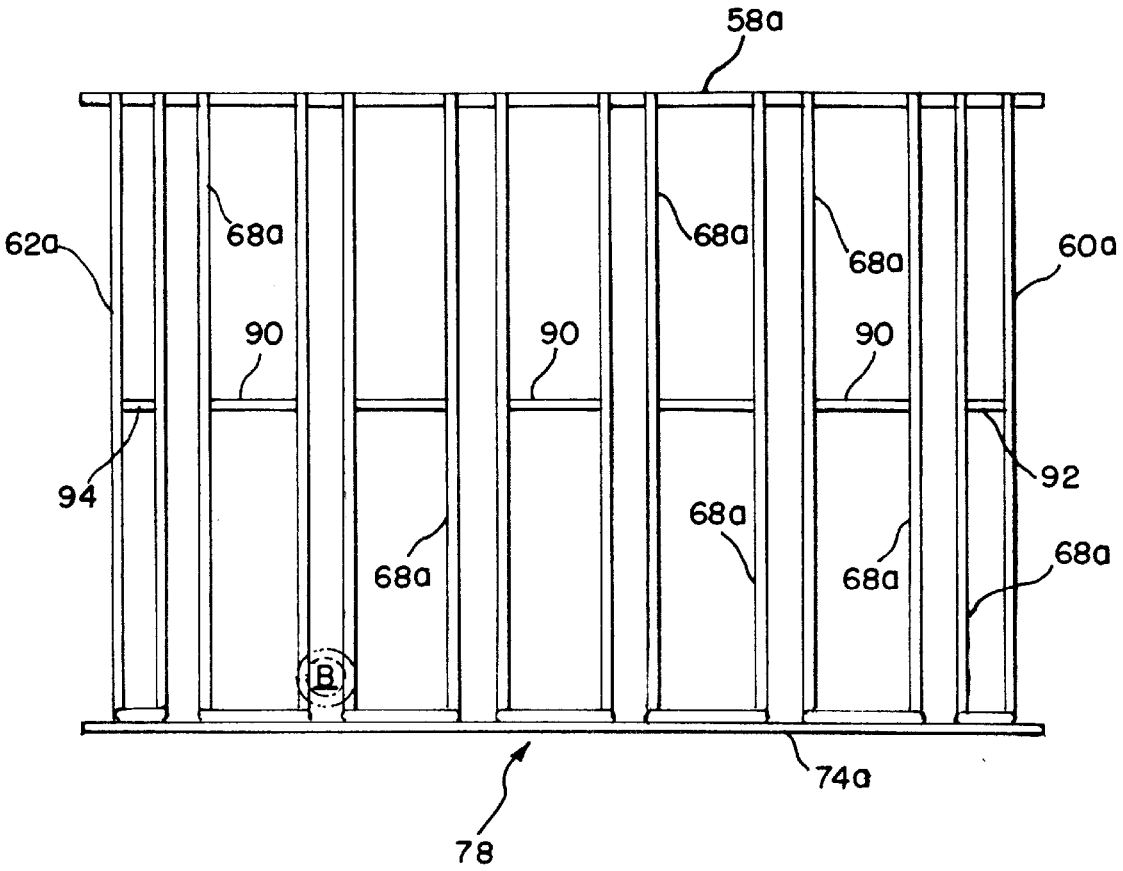
FIG. 9 is a plan view of a modified form of the shelf unit in FIG. 6.
Figure 10:
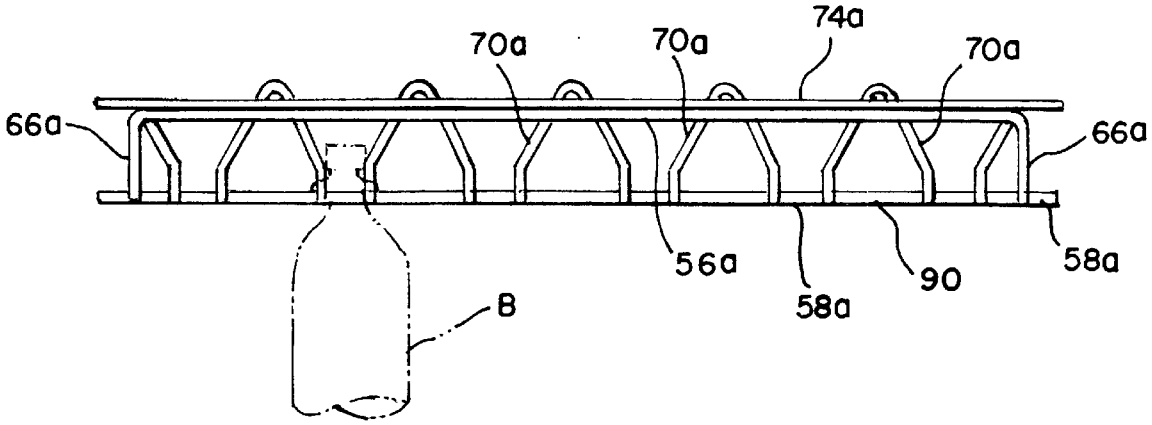
FIG. 10 is a front view of the shelf unit in FIG. 9.

FIGS. 9–11 illustrate a modified form of the shelf unit 54 in the second embodiment. The modified unit 78 is uniquely designed so that it may be used either in a horizontal position or in an inclined position wherein the unit 78 operates as a gravity feed bottle-dispensing device. The shelf unit 78 defers from the unit 54 in that the side members 60*a* and 62*a* do not have the cranked portions and thus do not provide the means for engagement with the support structure 44. Instead, the rear support member 58*a* and the reinforcing transverse member 74*a* provide the engaging means. Both the rear support member 58*a* and the reinforcing member 74*a* are extended outwardly beyond the side members 60*a* and 62*a* so that the opposite ends of each of the members 58*a* and 74*a* serve as the engaging means. The rear support member 58*a* is formed separately from the front and side members 74*a*, 60*a* and 62*a* which may be formed from a single continuous strip of wire. The rear ends of the side members 60*a* and 62*a* are welded to the rear support member 58*a*. The shelf unit 78 further defers from the unit 54 in that the longitudinal members 68*a* of each more widely spaced pair are interconnected at their horizontal portions by a strut 90 to prevent horizontal displacement of the horizontal portions. The side member 60*a* and the adjacent longitudinal member 68*a* are interconnected by a short strut 92 whereas the side member 62*a* and the adjacent longitudinal member 68*a* are interconnected by a shorter strut 94. The other wire arrangement of the unit 78 is virtually identical to that of the unit 54.

The shelf unit 78 may be mounted on the support structure 44 in the horizontal position wherein the longitudinal members 68*a* are disposed generally horizontally. The horizontal position of the unit 78 may be achieved by inserting the unit 78 between the side walls 48 such that the opposite ends of the reinforcing member 74*a* are received in a pair of opposed grooves 52 at an elevation higher than the pair of opposed grooves 52 in which the opposite ends of the rear support member 58*a* are received.

Alternatively, the shelf unit 78 may be supported in the inclined position wherein the longitudinal members 68*a* are inclined downwardly toward the upturned portions 70*a*. This inclined position may be achieved by using a single pair of opposed grooves 52 to support the shelf unit 78 so that the opposite ends of both the members 74*a* and 58*a* are received in the same pair of grooves 52. The angle of inclination of the longitudinal members 68*a* with respect to the horizontal may be about 1 to 20 degrees, preferably about 2 to 18 degrees and most preferably about 7 to 9 degrees. In the inclined position, the suspended bottles "B" are allowed to gravity feed one after another to the front ends of the tracks as the leading or foremost bottles on each track are removed successively from the tracks.

Figure 12:
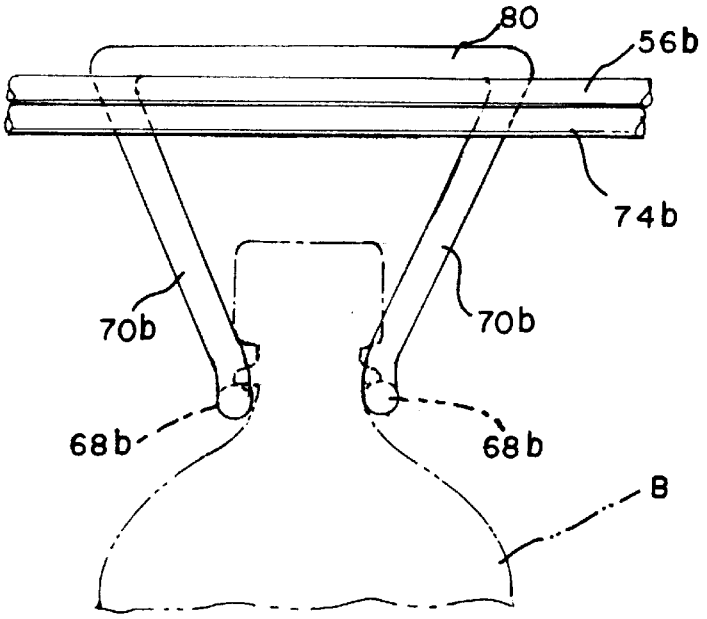
FIG. 12 is an enlarged front view of another modified forms of the shelf unit in FIG. 6.
Figure 13:
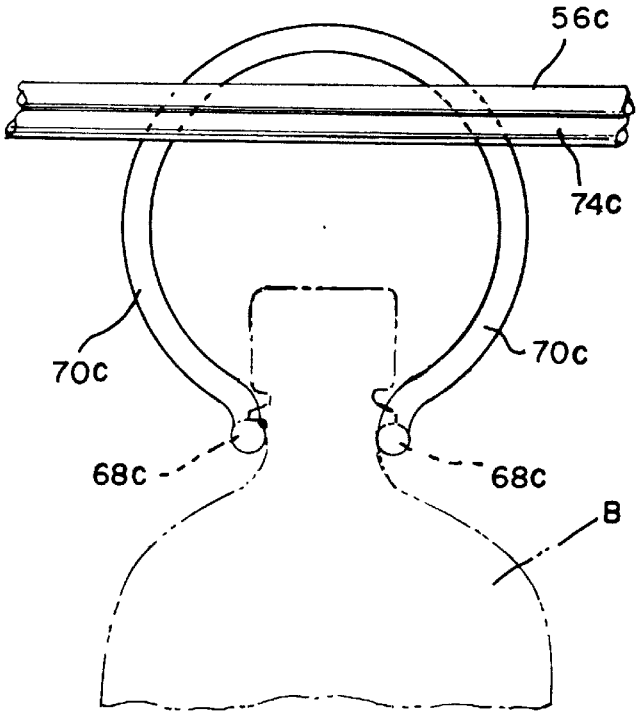
FIG. 13 is an enlarged front view of a further modified form of the shelf unit in FIG. 6.

FIGS. 12 and 13 illustrates other modified forms of the shelf unit in FIG. 6 wherein the longitudinal members of a track-forming pair are joined together at their respective upturned portions and are formed from a single continuous strip of wire. In FIG. 12, the upturned portions 70*b* of the longitudinal members 68*b* are interconnected at their upper ends by a horizontal bridge member 80. In FIG. 13, the joined upturned portions 70*c* of the longitudinal members 68*c* form a circular or oval loop. Reference numerals 56*b* and 56*c* in FIGS. 12 and 13 designate front support members while the reference numerals 74*b* and 74*c* denote transverse reinforcing members.

It will be recognized that many variations may be made to the foregoing within the scope of the present invention. For example, the upturned portions of the longitudinal members may be formed separately from their horizontal portions and may be welded to the forward ends of the horizontal portions to provide the divergent braces. In FIG. 1, the front posts 20 may be omitted while in FIGS. 7, 10, 12 and 13, the reinforcing members may be omitted. In FIG. 9, the longitudinal members 68*a* of each more widely spaced pair may be interconnected by two or more parallel struts to more strictly prevent horizontal displacement of their horizontal portions.

It should be further recognized that the divergent upturned portions may also be provided at the rear ends of the tracks so that bottles can be loaded from the rear ends of the track while preventing accidental dislodgement of the bottles through the rear ends.

It should be further recognized that the rack of the invention is capable of supporting not only bottles but also stemware such as wine glasses, goblets or the like.

What is claimed is:

1. A rack for flanged articles each having at a top portion thereof an integrally formed annular flange, comprising:

a pair of front and rear opposed parallel transverse support members; and a pair of longitudinal members extending between said front and rear support members, each of said longitudinal members being formed of a wire strip and comprising a straight portion and an upturned forward end portion, said straight portions of said longitudinal members extending forward from said rear support member to positions below said front support member, said straight portions being disposed to form a pair of spaced parallel rails for receiving therebetween a row of said articles such that said articles are slidably engaged at undersides of said flanges with said rails whereby said articles are suspended by said flanges for movement along said rails, said upturned forward end portions of said longitudinal members extending upward from said positions to said front support member and secured thereto to form brace means for interconnecting said rails and said front support member, said upturned forward end portions being divergent toward said front support member so that an exit for said articles is defined between said upturned forward end portions.

2. The rack according to claim 1, wherein said upturned forward end portions are divergent such that the distance between said upturned forward end portions gradually increases as said upturned forward end portions extend toward said front support member.

3. The rack according to claim 1, wherein said upturned forward end portions are divergent all the way from said positions to said front support member.

4. The rack according to claim 1, wherein said upturned forward end portions upwardly extend from said positions in a parallel relationship for some distance and are then turned away from each other to be divergent all the way to said front support member.

5. The rack according to claim 1, wherein said longitudinal members are joined together at their respective upturned forward end portions so that said longitudinal members are formed from a single continuous wire strip.

6. The rack according to claim 1, wherein a plurality of pairs of said longitudinal members are arranged side by side with their respective straight portions extending to positions below said front support member, and adjacent longitudinal members of neighboring pairs are joined together at their respective upturned forward end portions so that said adjacent longitudinal members are formed from a single continuous wire strip.

7. The rack according to claim 1, wherein an angle defined between said straight and upturned portions of said each longitudinal member is no more than 90 degrees.

8. The rack according to claim 1, further comprising vertical support means for supporting said longitudinal members in an elevated position, and said transverse support members are connected to said vertical support means.

9. The rack according to claim 8, wherein said vertical support means supports said longitudinal members such that said straight portions are inclined downwardly toward said positions whereby said articles when engaged by said straight portions are allowed to gravity feed toward said positions along said straight portions.

10. A rack for flanged articles each having at a top portion thereof an integrally formed annular flange, comprising:

a pair of front and rear opposed parallel transverse support members; and a plurality of elongate closed loops disposed side by side between said front and rear support members, each of said loops comprising a pair of longitudinal members extending between said front and rear support members, said longitudinal members of said each loop having upturned converging forward end portions respectively, adjacent longitudinal members of neighboring ones of said loops being disposed to form a pair of spaced apart rails for receiving therebetween a row of said articles such that said articles are slidably engaged at undersides of said flanges with said rails whereby said articles are suspended by said flanges for movement along said rails, said upturned forward end portions of said adjacent longitudinal members of neighboring ones of said loops extending upwardly and away from each other to said front support member so that an exit for said articles is defined by said upturned forward end portions of said adjacent longitudinal members of neighboring ones of said loops, said upturned forward end portions of said each loop being directly secured to said front support member to form brace means for interconnecting said rails and said front support member.

11. The rack according to claim 10, wherein said each loop has an upper forward end, and said upturned forward end portions of said each loop converge on said upper forward end of said each loop.

12. The rack according to claim 10, wherein said each loop is formed of a single wire strip.

13. The rack according to claim 10, further comprising vertical support means for supporting said loops in an elevated position, and said front and rear support members are connected to said vertical support means.

14. The rack according to claim 13, wherein said vertical support means supports said loops such that said rails are inclined forwardly and downwardly whereby said articles when supported by said rails are allowed to gravity feed toward said upturned forward end portions of said loops.

* * * * *